US005946812A

United States Patent [19]

Slates

[11] Patent Number: 5,946,812

[45] Date of Patent: Sep. 7, 1999

[54] ARCHERY BOW PIN SIGHT

[75] Inventor: Scott O. Slates, Wentzville, Mo.

[73] Assignee: Toxonics Manufacturing, Inc., Wentzville, Mo.

[21] Appl. No.: 08/977,277

[22] Filed: Nov. 24, 1997

[51] Int. Cl.[6] ..... F41G 1/46

[52] U.S. Cl. ..... 33/265; 124/87

[58] Field of Search ..... 33/265; 124/87

[56] References Cited

U.S. PATENT DOCUMENTS

| | | | |
|---|---|---|---|
| 4,414,751 | 11/1983 | Mathews | 33/265 |
| 4,462,163 | 7/1984 | Tentler et al. | 33/265 |
| 4,875,290 | 10/1989 | Finch | 33/265 |
| 5,509,402 | 4/1996 | Sappington | 124/87 |
| 5,524,601 | 6/1996 | Slates et al. | 124/87 |

*Primary Examiner*—Christopher W. Fulton
*Attorney, Agent, or Firm*—Paul M. Denk

[57] ABSTRACT

A pin sight assembly is provided which can be secured in a pin sight mounting assembly, which in turn, is mounted to a bow. The pin sight assembly includes a casing. A first member is received in one end of the casing and is positionally fixed relative to the casing, preferably by a force fit. A second member is received in the casing to be axially movable relative to the casing and the first member. A pin which passes through the first and second members and extends beyond the first and second members. The pin is positionally fixed relative to the first member, for example by a set screw. A cap receives a back end of said pin to hold the assembly together. A resilient member is positioned between the first and second members to bias the second member and hence the pin away from the first member. The cap is rotatable relative to the housing and, rotation of the cap moves the pin and the second member axially relative to the casing and the first member. The first and second members each include a body and a leg extending from a surface of the body. The legs of the first and second member extend toward each other in the casing. The legs each define complimentary arcs in end elevation, and cooperate with each other to prevent rotation the second member and hence the pin while the pin is moved axially when the cap is rotated.

7 Claims, 3 Drawing Sheets

ARCHERY BOW PIN SIGHT

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

Bow hunters typically use pin sights when hunting game. The pin sight includes at least one pin which is positioned on the bow and is used to aim at the target, such as a deer. Before an archer hunts, the pin is positioned on the bow for a certain distance, i.e., 100 yards. If the archer is to shoot at game at a different distance, the pin will have to be repositioned with respect to the bow, i.e., it will have to be moved vertically. Additionally, there are times when the pin has to be moved horizontally relative to the bow. In either of these instances, it is important that the pin remain generally perpendicular to the plane of the bow. On many bow sight mounts, when the pin is repositioned, the design of the mount does not ensure that the pin will remain in the desired perpendicular position.

U.S. Pat. Nos. 5,524,601 and 5,509,402, all of which are assigned to the same assignee of the current invention, and all of which are incorporated herein by reference, disclose pin mounts which maintain the pin perpendicular to the plane of the bow during adjustment of the pin. However, the pin mounts can be improved upon.

BRIEF SUMMARY OF THE INVENTION

A primary object of the present invention is to provide a pin sight assembly for a bow sight which will allow for translation of the pin perpendicular to the plane of the bow.

Another object is to provide such a pin sight assembly which will prevent rotation of the pin of the assembly during axial movement of the pin.

These and other objects will become apparent to those skilled in the art in light of the following disclosure and accompanying drawing.

Briefly stated, a pin sight assembly is provided which can be secured in a pin sight mounting assembly, which in turn, is mounted to a bow. The pin sight assembly includes a casing. A first member is received in one end of the casing and is positionally fixed relative to the casing, preferably by a force fit. A second member is received in the casing to be axially movable relative to the casing and the first member. A pin passes through the first and second members and extends beyond the first and second members. The pin is positionally fixed relative to the first member, for example by a set screw. A cap receives a back end of the pin to hold the assembly together. A resilient member is positioned between the first and second members to bias the second member and hence the pin away from the first member. The cap is rotatable relative to the housing and, rotation of the cap moves the pin and the second member axially relative to the casing and the first member. The first member, as noted is positionally fixed relative to the casing. The second member is sized to be slidably received in the casing. The first and second members cooperate with each other to prevent rotation of the first member, and hence the pin, when the pin is axially moved by rotation of the cap.

The first and second members each include a body and a leg extending from a surface of the body. The legs of the first and second member extend toward each other in the casing. The legs each define an arc in end elevation, and cooperate with each other to prevent rotation the second member and hence the pin while the pin is moved axially when the cap is rotated. The legs of the first and second members are sized to extend over each other or to telescope relative to each other, and to cooperate with each other to prevent rotation of the pin during axial movement of the pin. The legs preferably define arcs in end elevation, and, in combination, the arcs of the legs substantially define a cylinder. Preferably, the legs are each substantially semicircular in end elevation.

The legs of the first and second members each define an arc having a radius less than a radius of the bodies of the first and second members. The bodies each have a shoulder at a junction between said bodies and said legs. In one embodiment, the resilient member comprises a spring which extends between the shoulders of the first and second members. In another embodiment, the resilient member comprises a first spring which abuts the shoulder of the first member, a second spring which abuts the shoulder of the second member, and a spacer positioned between the springs.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, including what we presently believe is the best mode of carrying out the invention.

Figure 1:
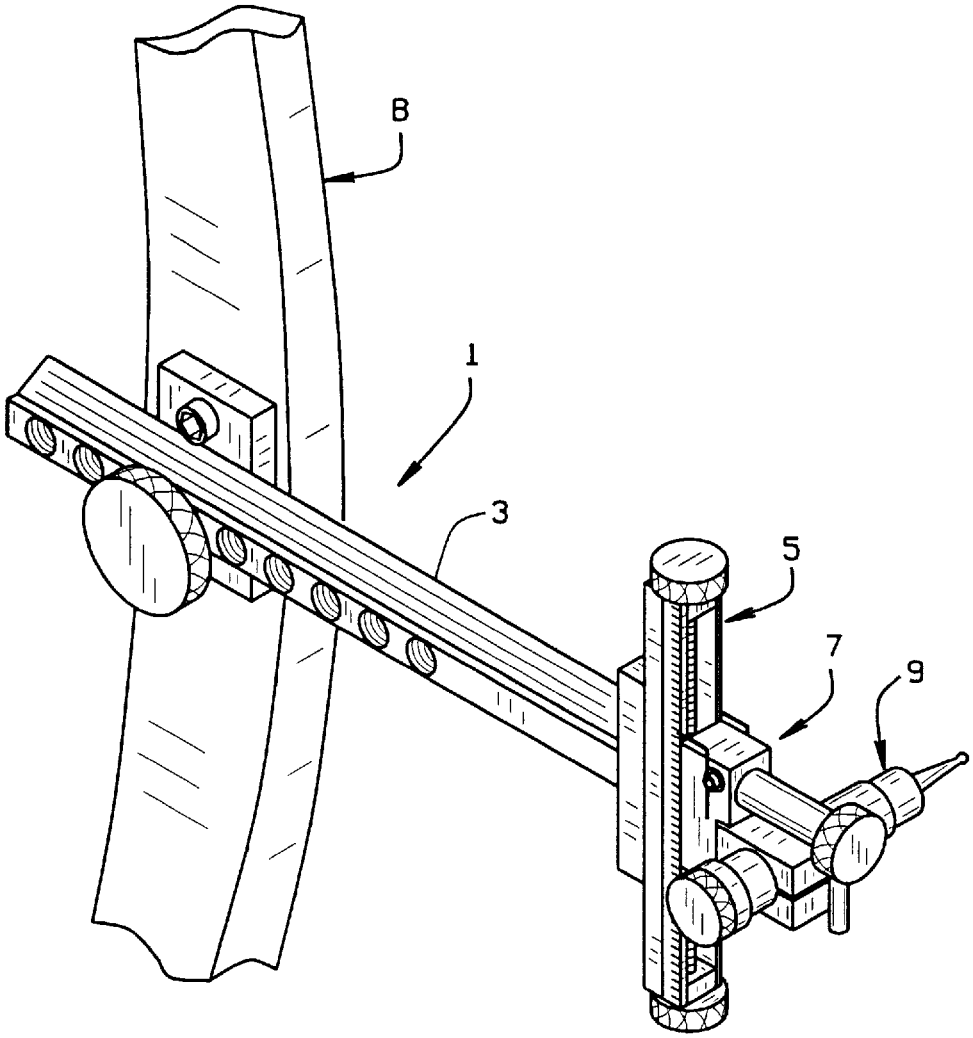
FIG. 1 is a perspective view of a bow having a pin assembly of the present invention mounted thereto.

A bow B is shown generally in FIG. 1 with a sight assembly 1 mounted thereon. The sight assembly 1 includes a slide arm 3 which is mounted to the bow, for example as disclosed in U.S. Pat. No. 5,524,601, which is incorporated herein by reference. A slide bar 5 is mounted to the end of the slide arm 3. A pin mount 7 in turn is slidably mounted to the bar 5, and a pin assembly 9 of the present invention is mounted to the pin mount. The pin mount 7 and slide bar 5 may, for example, be constructed in accordance with U.S. Pat. No. 5,509,402, which is incorporated herein by reference.

Figure 2:
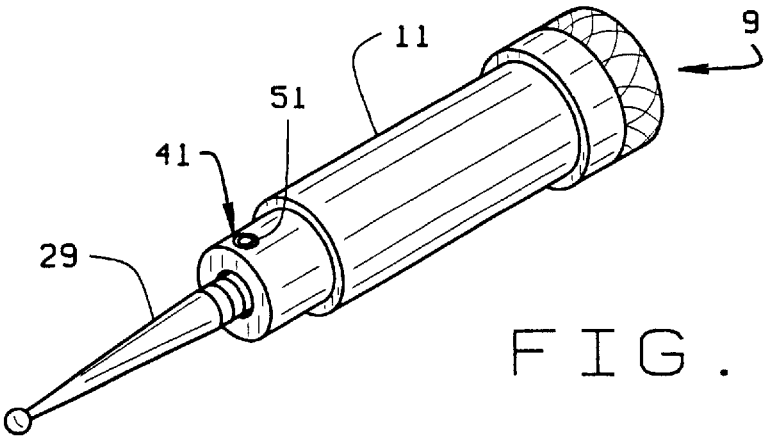
FIG. 2 is a perspective view of the pin assembly of the present invention.
Figure 3:
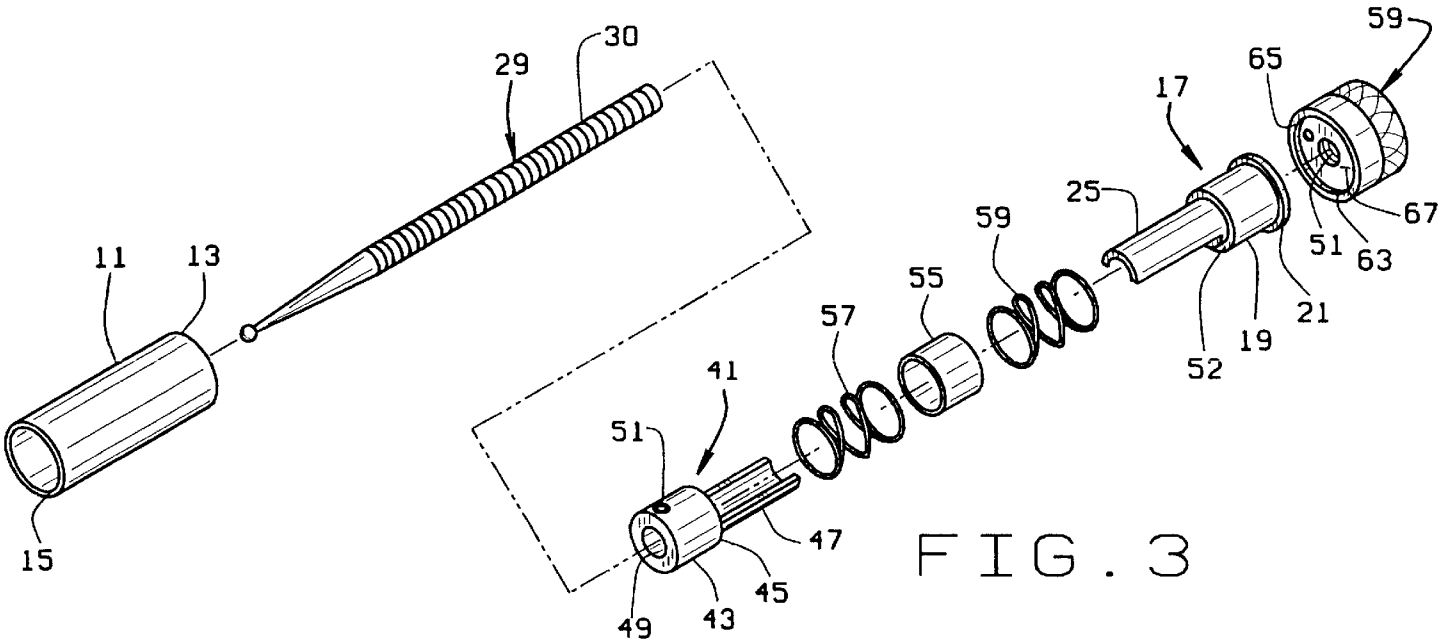
FIG. 3 is an exploded, perspective view of the pin assembly.
Figure 4:
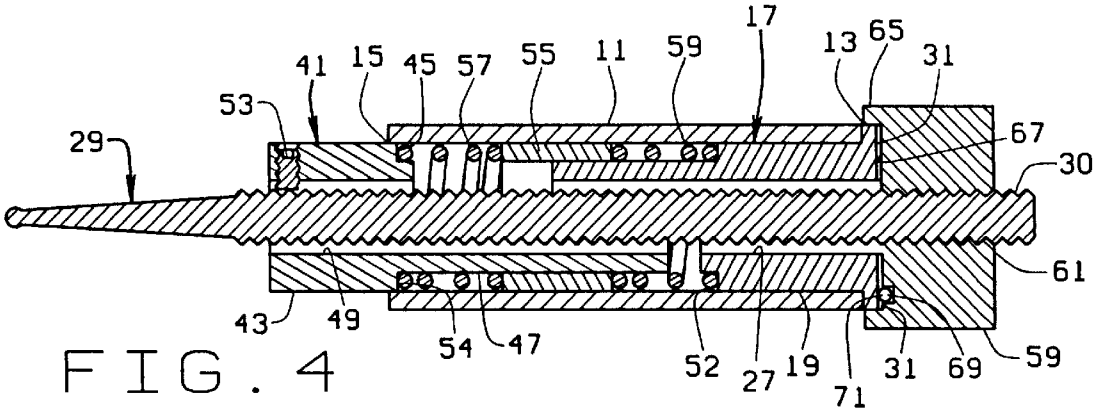
FIG. 4 is a cross-sectional view of the pin assembly.

Turning to FIGS. 2–4, the pin assembly 9 includes a hollow cylindrical casing 11 having a back end 13 and a front end 15. An end member 17 is received in the back end 13 of the casing 11. The end member 17 has a body 19 which is sized to be force fit into the casing 11. A circumferential flange 21 extends from the back surface 23 of the end member body 19. The flange 21 has an outer diameter substantially equal to the outer diameter of the casing 11. A semi-circular leg 25 extends from the front of the body 19. The body 19 also includes a passage 27 sized to allow a pin 29 having a threaded shaft 30 to slidingly extend therethrough. Lastly, the back surface 23 of the body 19 has a plurality of grooves 31 radiating outwardly from the passage 27. The grooves are evenly spaced about the back surface 23. For example, there can be ten grooves spaced apart by about 36°.

A second, front member 41 is received in the front of the casing 11. The member 41 is substantially similar to the member 17, and includes a body 43 having a back surface 45 and a semi-circular leg 47 extending rearwardly from the body back surface 45. The body 43 is slightly smaller in diameter than the first member body 19, and is sized to be slidable relative to the casing 11. Thus, the body 43 has an outer diameter slightly smaller than the inner diameter of the casing 11. A central passage 49 extends through the body 43, and the pin 29 extends through the passage 49 and beyond the front end of the second member 41 so that its tip may be used to aim at a target, as is known. A radial passage 51 is positioned near the front of the second member body 43 to receive a set screw 53. The set screw 53 is tightened against the pin 29 to positionally fix the pin 29 and the second member 41 with respect to each other.

The legs 25 and 47 of the first and second members 17 and 41, respectively, are sized such that the legs overlap each other when received in the casing 11. Each leg defines an arc of less then 180°, so that the second member leg 47 can slide relative to the first member leg 25, when the members are received in the casing 11. The legs each define a circle having a diameter less then the diameter of the bodies 19 and 43 of the members 17 and 41, respectively. Thus, each member has a shoulder 52, 54.

The pin assembly 9 further includes a spacer 55 and front and back spiral springs 57 and 59. The spacer 55 is positioned between the first and second members 17 and 41. It is journaled about their legs as seen in FIG. 4. The front spring 57 is positioned between the second member shoulder 54 and a front edge of the spacer 55. The back spring is positioned between the first member shoulder 52 and a back edge of the spacer 55. As noted above, the first member 17 is positionally fixed in the casing 11. Thus the springs 57 and 59 act to bias the second member 41 (and hence the pin 29) forwardly relative to the casing 11.

A cap 59 is received at the back of the assembly. The cap 59 has an internally threaded passage 61 which extends axially through the center of the cap. The shaft 30 of the pin 29 is threaded through the passage 61. The cap 59 has an outer diameter greater than the outer diameter of the casing 11, and thus has a counterbore 63 defined by a lip 65 having a diameter slightly greater than the diameter of the casing 11 so that the counterbore 63 will fit over the back end 13 of the casing 11. The counterbore 63 has an inner surface 67. A small bore 69 extends upwardly from the surface 67 into the cap 59. A small ball 71 is received in the bore 69 and is biased forwardly towards the surface 67 by a spring. The ball 69 is sized to be received in the grooves 31 of the first member 17 to index the rotation of the cap 59 about the casing.

To manufacture the pin assembly 9, the first member 17 is force fit in the back of the casing 11 until the shoulder 21 abuts the back end 13 of the casing. The back spring 59, the spacer 55, and the front spring 57 are then inserted into the casing 11 from its front. The pin 29 is passed through the passage 49 of the second body 41, such that the second member leg extends over the pin shaft 30. The pin 29 is then fixed in place relative to the second member 49 by tightening the set screw 53 against the pin. The pin/second member sub-assembly is then inserted into the casing from the front thereof and the pin shaft 30 is passed through the central passage 27 of the first member. The cap 59 is then screwed onto the back end of the pin shaft 30 to hold the pin 29 and the second member 41 in the casing 11.

The legs 25 and 47 of the first and second members cooperate to define a cylinder. Because the first member 17 (and hence the first member leg 25) is positionally fixed relative to the casing 11, the first member leg 25 acts as a key. The second member 41 can thus be inserted into the casing 11 in only one rotational position, and once in the casing 11, cannot rotate relative to the casing 11. Thus, the second member 41 (and hence the pin 29) can only move axially relative to the casing.

When the cap 59 is rotated, the cap's threaded passage 61 will interact with the threaded pin shaft 30 to move the pin 29 axially relative to the casing 11. The interaction of the legs 25 and 47 with each other will prevent the pin 29 from rotating relative to the casing. This will thus assure that rotation of the cap 59 will move the pin 29. The springs 57 and 59, of course, will bias the pin 29 and the second member 41 away from the first member 17.

Figure 5:
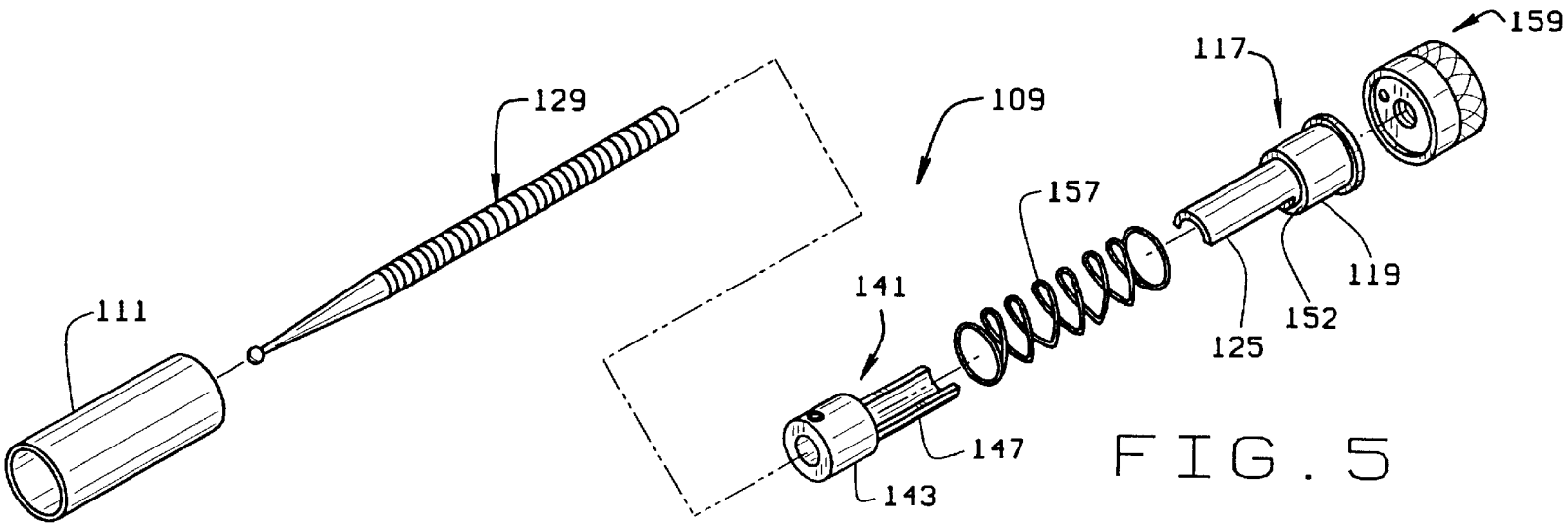
FIG. 5 is an exploded, perspective view of a second embodiment of the pin assembly.
Figure 6:
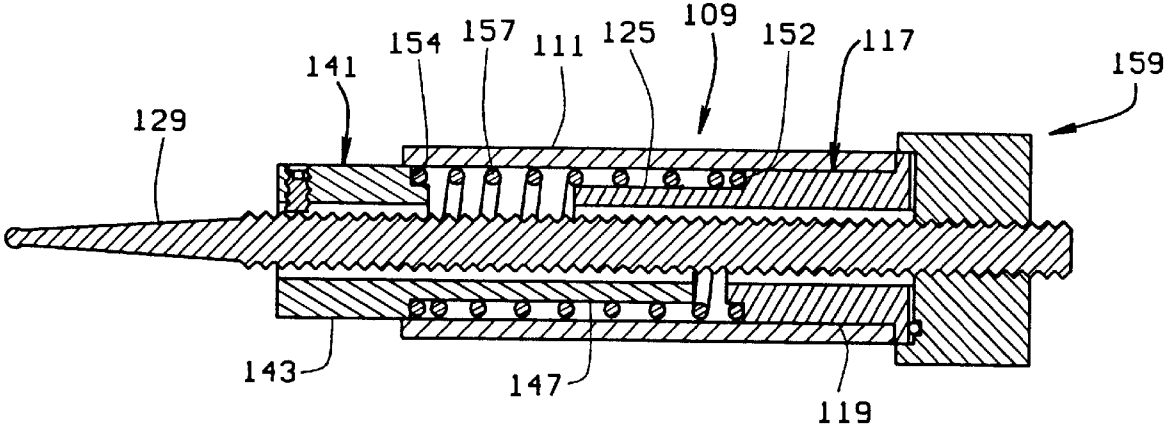
FIG. 6 is a cross-sectional view of the pin assembly of FIG. 5.

Turning to FIGS. 5–6, a second embodiment 109 of the pin assembly is shown. The pin assembly 109 is substantially similar to the pin assembly 9. It includes a casing 111, a first member 117, a second member 141, and a cap 159, which are identical to their counterparts in the assembly 9 of FIGS. 3 and 4. Each of the members has legs 125 and 147, respectively, which extend from the member bodies 119 and 143. The legs, which are semi-circular in end elevation, each have an arc with a radius less then the radius of the body. Thus, the legs and bodies define shoulders 152 and 154. A pin 129 is received in the first and second members 117 and 141, and the cap 159 in the same manner as the pin 29 is received in the assembly 9. The pin assembly 109 differs from the assembly 9 only in that the assembly 109 includes a single spring 157, rather than the two springs 57 and 59 and the spacer 55 of assembly 9, to bias the pin 129 forwardly away from the second member. Operation of the assembly 109 is identical to operation of the assembly 9.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. For example, the legs of the first and second members could be made of larger and smaller arcs. That is, one of the legs could define an arc of greater than 180° and the other leg could define a complementary arc of less than 180°. However, to prevent rotation of the pin and the second member, the two legs should define substantially a complete circle. To allow axial motion of the first member leg relative to the second member leg, the arcs of the two legs will be slightly less than the 360° of a complete circle. Rather than using arced legs, the legs could be cylindrical posts which telescope relative to each other. To prevent rotation of the first member, one of the legs could have an axial rib which is received in an axial groove on the other leg. The springs which bias the pin forwardly could be replaced with other resilient members which function will function to bias the pin forwardly. The pin could be positionally fixed relative to the first member using other means. For example, the passage of the first member could be threaded, and the pin could be screwed into the first member. This would eliminate the need for the set screw and the set screw hole associated with the first member. These examples are merely illustrative.

I claim:

1. A pin sight assembly for use with an archery bow, the pin sight assembly comprising a casing, a first member received in one end of said casing and being positionally fixed relative to said casing; a second member received in said casing to be axially movable relative to said casing and said first member, a pin which passes through said first and second members and extends beyond said first and second members; said pin being positionally fixed relative to said second member; a cap which receives a back end of said pin; and a resilient member positioned between said first and second members to bias said second member and hence said pin away from said first member; said cap being rotatable relative to said casing, whereby rotation of said cap moves said pin and said second member axially relative to said casing and said first member; said first and second members each having a body and a leg extending from a surface of said body; said legs of said first and second member being sized such that said second member leg slides past said first member leg when said pin is moved by rotation of said cap; said legs cooperating with each other to prevent said second member and said pin from rotating relative to said casing during axial translation of said pin.

2. The pin sight assembly of claim 1 wherein said legs each define an arc in end elevation; the legs cooperating with each other to prevent rotation of said second member and said pin relative to said casing.

3. The pin sight assembly of claim 2 wherein said legs cooperate to define a cylinder, the arc of said legs being sized to allow said leg of said second member slide relative to the leg of said first member.

4. The pin sight assembly of claim 3 wherein each of said legs is substantially semi-circular in end elevation.

5. The pin sight assembly of claim 1 wherein said resilient member comprises a spring, said spring extending between said first and second members.

6. The pin sight assembly of claim 1 wherein said resilient member comprises a first spring which abuts an inner surface of said first member, a second spring which abuts an inner surface of said second member, and a spacer positioned between said springs.

7. The pin sight assembly of claim 1 wherein said legs define complementary arcs in end elevation, said legs each defining an arc having a radius less than a radius of the bodies of the first and second members, said bodies each having a shoulder at a junction between said bodies and said legs, said resilient member having a first end abutting said shoulder of said first member and a second end abutting said shoulder of said second member.

* * * * *